US005101796A

United States Patent [19]

Matsumura et al.

[11] Patent Number: 5,101,796

[45] Date of Patent: Apr. 7, 1992

[54] FUEL INJECTION CONTROL SYSTEM FOR INTERNAL COMBUSTION ENGINE WITH PRECISE AIR/FUEL MIXTURE RATIO CONTROL

[75] Inventors: Toshio Matsumura; Yasutoshi Nanyoshi, both of Kanagawa, Japan

[73] Assignee: Nissan motor Company, Limited, Kanagawa, Japan

[21] Appl. No.: 657,260

[22] Filed: Feb. 19, 1991

Related U.S. Application Data

[63] Continuation of Ser. No. 311,330, Feb. 16, 1989, abandoned.

[30] Foreign Application Priority Data

Feb. 17, 1988 [JP] Japan ..... 63-34390

[51] Int. Cl.[5] ..... F02D 41/10

[52] U.S. Cl. ..... 123/492; 123/478

[58] Field of Search ..... 123/478, 480, 492, 493

[56] References Cited

U.S. PATENT DOCUMENTS

| | | | |
|---|---|---|---|
| 4,086,884 | 5/1978 | Moon et al. | 123/480 |
| 4,357,923 | 11/1982 | Hideg | 123/493 |
| 4,388,906 | 6/1983 | Sugiyama et al. | 123/493 |
| 4,454,847 | 6/1984 | Isomura et al. | 123/493 |
| 4,664,090 | 5/1987 | Kabasin | 123/478 |
| 4,667,640 | 5/1987 | Sekozawa et al. | 123/492 |
| 4,750,352 | 6/1988 | Kolhoff | 123/480 |
| 4,852,538 | 8/1989 | Nagaishi | 123/480 |
| 4,892,072 | 1/1990 | Miwa et al. | 123/340 |
| 4,903,668 | 2/1990 | Ohata | 123/478 |
| 4,905,653 | 3/1990 | Manaka et al. | 123/480 |
| 4,939,658 | 7/1990 | Sekozawa et al. | 123/480 |

FOREIGN PATENT DOCUMENTS 60206241 9/1987 Japan .

*Primary Examiner*—Tony M. Argenbright

*Attorney, Agent, or Firm*—Lowe, Price, LeBlanc & Becker

[57] ABSTRACT

A fuel injection control system derives a target fuel amount to be introduced into a combustion chamber of an internal combustion engine in each induction stroke in the engine revolution cycle, according to an engine driving condition for establishing a desired air/fuel ratio of an air/fuel mixture in the combustion chamber. The target fuel amount is modified with a fuel transferrring characteristics dependent correction value which is derived as the reverse of a fuel transferring characteristic when the injected fuel amount coincides with the fuel amount introduced into the combustion chamber. The fuel injection amount for actual fuel injection is thus derived so that the injected fuel amount coincides with the modified target fuel amount.

7 Claims, 5 Drawing Sheets

FUEL INJECTION CONTROL SYSTEM FOR INTERNAL COMBUSTION ENGINE WITH PRECISE AIR/FUEL MIXTURE RATIO CONTROL

This application is a continuation of application Ser. No. 07/311,330 filed Feb. 16, 1989, now abandoned.

BACKGROUND OF THE INVENTION

1. Field of the Invention

The present invention relates generally to a fuel injection control system for an internal combustion engine. More specifically, the invention relates to a fuel injection control system which can precisely control air/fuel ratio of an air/fuel mixture actually combusted in a combustion chamber of the engine.

2. Description of the Background Art

In general, fluctuation of air/fuel ratio from a target or stoichiometric value is caused by variation of fuel amount consumed for wetting intake manifold, intake port and so forth and variation of amount of fuel suspended in the induction system. The fuel consumed for wetting the intake manifold and intake port will be hereafter referred to as "wetting fuel" and amount of fuel consumed as wetting fuel will be hereafter referred to "wetting fuel amount". On the other hand, the fuel suspended in the induction system will be hereafter referred to as "suspending fuel" and the amount of the suspended fuel will be hereafter referred to as "suspending fuel amount". The wetting fuel amount and suspending fuel amount are variable depending upon the engine driving condition. Variation of the wetting and suspending fuel amount are not linear or stepwise but non-linear in nature. Furthermore, variations of wetting fuel amount and suspending fuel amount occurs with a time delay which is not defined by a given time constant. In addition, the wetting fuel amount and suspending fuel amount vary not only according to the instantaneous engine driving condition but also according to difference between the instantaneous wetting and suspending fuel amount and the wetting and suspending fuel amount in the steady state. Therefore, dynamic characteristics of a fuel system using the induction system is indeterminate since part of injected fuel may be consumed as wetting fuel and part of fuel on the periphery of the induction system is vaporized to be introduced into the combustion cylinder with the injected fuel. Therefore, it is difficult or rather impossible to precisely control the air/fuel ratio at the stoichiometric value.

Japanese Patent First (unexamined) Publication (Tokkai) Showa 60-166731 discloses a fuel injection control system. In the disclosed system, the wetting fuel amount is assumed or projected on the basis of the transition period of an oxygen concentration indicative signal produced by an oxygen sensor provided in an exhaust system, which transition period varies according to engine speed. The fuel injection amount is controlled on the basis of the assumed or projected wetting fuel amount so as to maintain the air/fuel ratio near the stoichiometric value for anti-pollution purposes.

When feedback control of the air/fuel ratio is performed for controlling fuel injection amount on the basis of the oxygen concentration indicative signal of the oxygen sensor in the engine which has relatively large amount of wetting fuel amount and fuel vaporization amount, hunting in fuel injection amount control can occur, making air/fuel ratio worse.

SUMMARY OF THE INVENTION

Therefore, it is an object of the present invention to provide a fuel injection control system which can precisely control air/fuel ratio of an air/fuel mixture in an engine combustion chamber.

Another object of the invention is to provide a precisely air/fuel ratio control utilizing fuel transfer characteristics for transferring injected fuel to a combustion chamber of the engine.

A further object of the invention is to provide an air/fuel ratio control which does not require oxygen sensor for precisely controlling air/fuel ratio of an air/fuel mixture introduced into the combustion chamber of the engine.

In order to accomplish aforementioned and other objects, a fuel injection control system, according to the present invention, derives a target fuel amount to be introduced into a combustion chamber of an internal combustion engine in each induction stroke in the engine revolution cycle, according to an engine driving condition for establishing a desired air/fuel ratio of an air/fuel mixture in the combustion chamber. The target fuel amount is modified with a fuel transferring characteristics dependent correction value which is derived as a reverse of a fuel transferring characteristic obtained when the injected fuel amount coincides with the fuel amount introduced into the combustion chamber. The fuel injection amount for actual fuel injection is thus derived so that the injected fuel amount becomes coincident with the modified target fuel amount.

According to one aspect of the invention, a fuel injection control system for an internal combustion engine, comprises:

a sensor means for monitoring an engine driving condition to produce an engine driving condition indicative parameter signal first means for deriving a target air/fuel ratio of an air/fuel mixture combusted in a combustion chamber of the engine, the first means deriving a target fuel amount to be introduced into the combustion chamber for establishing the target air/fuel ratio second means for deriving a lag factor in variation of a fuel amount introduced into the combustion chamber in relation to variation of a fuel injection amount and deriving a correction value for correcting the target fuel amount and third means for deriving a fuel injection control signal based on the target fuel amount for injecting a fuel in an amount corresponding to the target fuel amount.

According to another aspect of the invention, an air/fuel ratio control system for an internal combustion engine, comprises:

a sensor means for monitoring an engine driving condition to produce an engine driving condition indicative parameter signal first means for deriving a target air/fuel ratio of an air/fuel mixture combusted in a combustion chamber of the engine on the basis of the engine driving condition indicative parameter signal, the first means deriving a target fuel amount to be introduced into the combustion chamber for establishing the target air/fuel ratio on the basis of an intake air amount to be introduced into the combustion chamber second means for deriving a wetting fuel dependent lag factor depending upon an amount of fuel left on an inner periphery of an induction system of the engine, in variation of a fuel amount introduced in to the combustion chamber in relation to variation of a fuel injection amount and deriving a correction value for correcting the target fuel amount and third means for deriving a fuel injection control signal based on the target fuel amount for injecting a fuel in an amount corresponding to the target fuel amount.

The sensor means may monitor a throttle valve angular position, an intake air pressure and an intake air temperature, and the system may comprise fourth means for deriving the intake air amount to be introduced into the combustion chamber on the basis of the throttle valve angular position, the intake air pressure and the intake air temperature.

The second means may be so designed as to derive the correction value based on known variation characteristics of fuel amount to be introduced into the combustion chamber in relation to stepwise variation of the fuel injection amount. In practice, the second means varies the correction value according to a correction value variation characteristics which has reversed characteristics to the variation characteristics of the fuel amount to be introduced into the combustion chamber.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
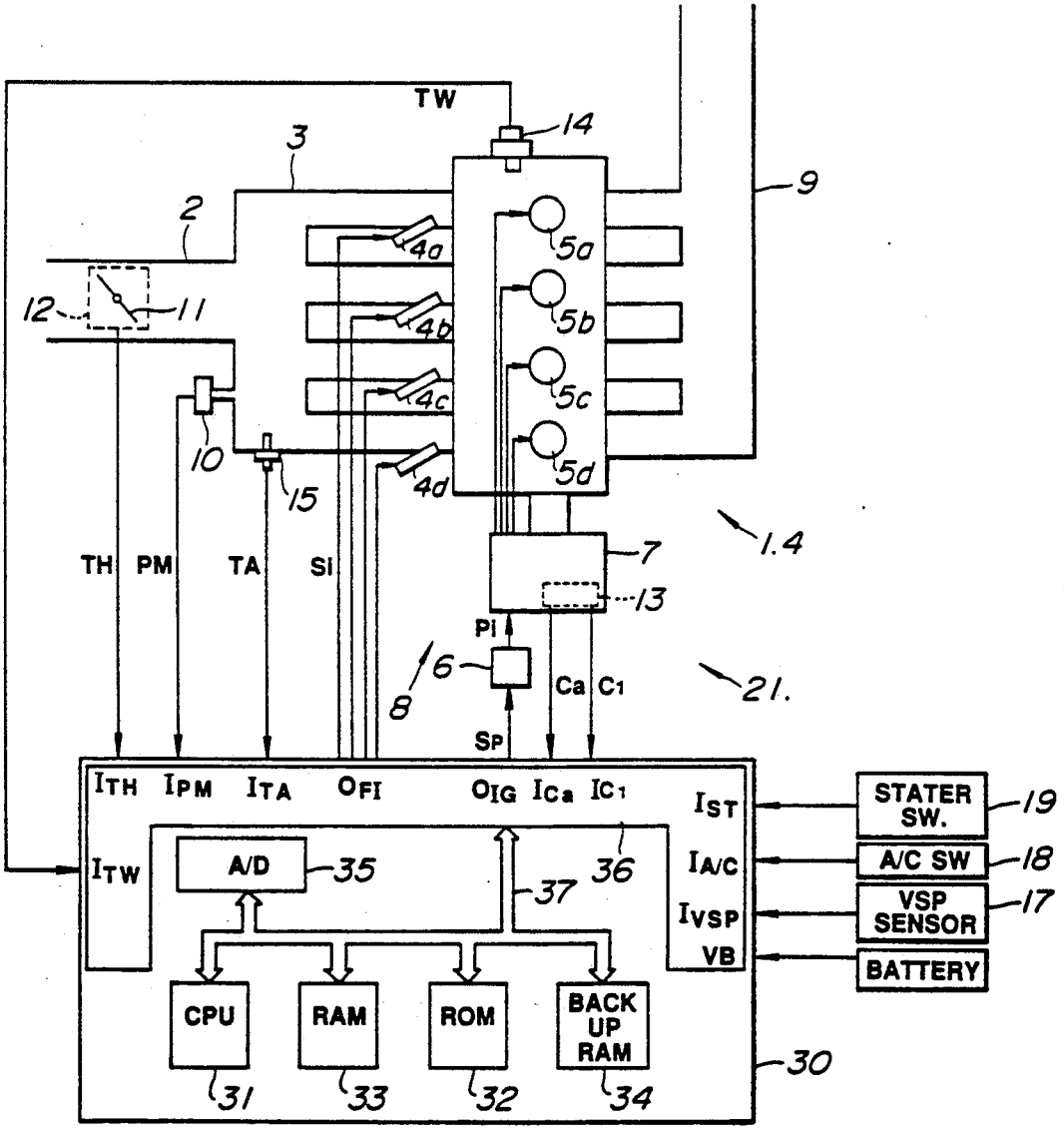
FIG. 1 is a schematic diagram showing overall construction of the preferred embodiment of a fuel injection control system according to the present invention.

Referring now to the drawings, particularly to FIG. 1, the preferred embodiment of a fuel injection control system, according to the present invention, will be discussed herebelow in terms of that applied for a 4-cylinder fuel injection internal combustion engine 1. The engine 1 has an induction system 2 which includes an intake manifold 3 which has four branches respectively connected to corresponding engine cylinders. Into respective branches of the intake manifold 3, fuel injection valve 4*a*, 4*b*, 4*c* and 4*d* are inserted for injecting fuel for forming an air/fuel mixture to be introduced into respectively associated engine cylinders. The fuel injection valves 4*a*, 4*b*, 4*c* and 4*d* are controlled by fuel injection signal Si.

Spark ignition plugs 5*a*, 5*b*, 5*c* and 5*d* are provided for respective engine cylinders for performing combustion in respective combustion chamber. The spark ignition plugs 5*a*, 5*b*, 5*c* and 5*d* are driven by spark ignition pulse Pi generated by an ignitor 6 and distributed through a distributor 7. The ignitor 6 is controlled as to the trigger timing by a spark ignition control signal Sp. A crank angle sensor 13 is incorporated in the distributor 7 so as to monitor angular position of a rotor of the distributor, which rotor rotates in synchronism with the engine revolution cycle. The ignition plugs 5*a*, 5*b*, 5*c* and 5*d*, the ignitor 6 and the distributor 7 forms a spark ignition system 8. The crank angle sensor 13 produces a crank reference signal Ca at every predetermined angular position, i.e. 70° before top-dead-center (BTDC) of respective engine cylinder, and a crank position signal $C_1$at every given angular displacement, e.g. 2°.

Each combustion chamber of the engine 1 is connected to an exhaust manifold 9*a* of an exhaust passage 9. A catalytic converter (not shown) is provided in the exhaust passage for removing pollutant components, such as CO, HC, $No_X$in the exhaust gas and thereby for purification of the exhaust gas for anti-pollution purposes.

A throttle valve 11 is provided in the induction system 2 for controlling intake air flow rate. The throttle valve 11 is associated with a throttle angle sensor 12 for monitoring angular position of the throttle valve to produce a throttle angle indicative signal TH representative of the throttle valve angular position. An intake air pressure sensor 10 is provided in the intake manifold 3 for monitoring the pressure of the intake air and produces an intake air pressure indicative signal PM.

The intake air pressure sensor 10, the throttle angle sensor 12 and the crank angle sensor 13 are connected to a control unit 30. The control unit 30 has an input port $I_{PM}$ connected to the intake air pressure sensor to receive the intake air pressure indicative signal PM therethrough. An intake port $I_{TH}$ is provided for connecting the control unit 30 to the throttle angle sensor 12 to receive therefrom the throttle angle indicative signal TH. An intake ports $I_{Ca}$ and $I_{C1}$ are connected to the crank angle sensor 13 to receive therefrom the crank reference signal Ca and the crank position signal $C_1$. The control unit 30 has output ports $O_{FI}$ connected to the fuel injection valves 4*a*, 4*b*, 4*c* and 4*d* for supplying the fuel injection signals Si for controlling fuel injection timing and fuel injection amount. The control unit 30 is further provided with an output port $O_{IG}$ connected the ignitor 6 for supplying the spark ignition control signal Sp to control spark ignition timing.

In addition, the control unit 30 is connected to an engine coolant temperature sensor 14, an intake air temperature sensor 15, a vehicle speed sensor 17, an air conditioner switch 18, a starter switch 19 and a vehicular battery 20 as a power source through respective input ports $I_{Tw}$, $I_{TA}$, $I_{VSP}$, $I_{A/C}$, $I_{ST}$ and a power input terminal VB.

The engine coolant temperature sensor 14 is inserted in a water jacket defined in the engine block to monitor an engine coolant temperature. The engine coolant temperature sensor 14 produce an engine coolant temperature indicative signal Tw. The intake air temperature sensor 15 is provided in the intake manifold 3 for monitoring the intake air temperature flowing through the intake manifold to produce an intake air temperature indicative signal TA. The vehicle speed sensor 17 monitors vehicle speed to produce a vehicle speed indicative signal VSP. The air conditioner switch 18 is connected to the control unit 30 to feed HIGH level air conditioner active state indicative signal while an air conditioner switch is held ON. The starter switch 19 is responsive to turning an ignition switch at the starter position to feed HIGH level engine cranking condition indicative signal.

The control unit 30 comprises an input/output unit 36 having the aforementioned input and output ports $I_{PM}$, $I_{TH}$, $I_{CA}$, $I_{Cl}$, $I_{VSP}$, $I_{A/C}$, $I_{ST}$, $I_{Tw}$, $O_{FI}$, $O_{IG}$ and so forth. The control unit 30 also has CPU 31, ROM 32, RAM 33, back-up RAM 34 and an analog-to-digital (A/D) converter 35. The input/output unit 36, CPU 31, ROM 32, RAM 33, back-up RAM 34 and A/D converter 35 are connected to each other by data bus 37. CPU 31 performs fuel injection and spark ignition control operation according to programs stored in ROM 32. The back-up RAM 34 comprises a non-volatile memory for maintaining stored data even when the power supply is turned OFF.

Figure 2:
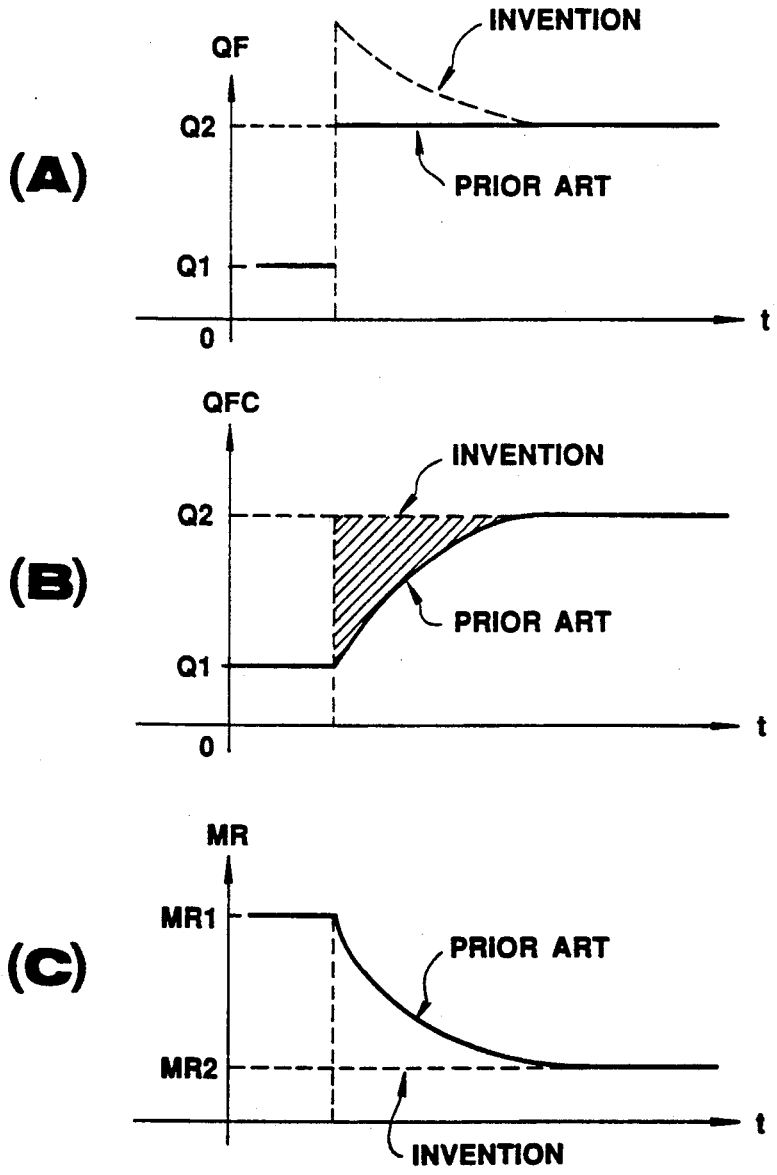
FIGS. 2(A), 2(B) and 2(C) respectively shown variation of fuel injection amount, fuel amount to be introduced into a combustion chamber of an internal combustion engine, and an air/fuel ratio of an air/fuel mixture in the combustion chamber, in the present invention and the prior art.

Here, assuming fuel injection amount QF is increased from $Q_1$ to $Q_2$ as illustrated in FIG. 2(A), the amount QFC of fuel to be introduced into the combustion chamber in the conventional fuel injection system varies as shown by solid line in FIG. 2(B). As will be seen from FIG. 2(B), the fuel amount to be introduced into the combustion chamber increases in non-linear fashion to reach the amount corresponding to the increased duel injection amount $Q_2$ with a certain lag time. This lag time is cause by leaving part of injected fuel in the induction system. According to lag in increasing of the fuel amount to be introduced into the combustion chamber, air/fuel ratio may vary from from a value $MR_1$ to a value $MR_2$ with substantially corresponding lag time, as shown in FIG. 2(C).

Lag in adjusting the air/fuel ratio from $MR_1$to $MR_2$ in response to variation of the fuel injection amount from $Q_1$ to $Q_2$ clearly causes a lean mixture in the transition period to degrade engine acceleration characteristics. In order to improve response characteristics in air/fuel ratio control in the combustion chamber, the present invention compensates for the amount of fuel wetting the inner periphery of the induction system and thus left in the induction system. According to the preferred process, compensation of wetting fuel amount is done by modifying the fuel injection amount according to the reversal of fuel amount variation characteristics which reflects fuel transferring characteristics when the injected fuel is transferred from the induction system to the combustion chamber, in the transition period as shown by broken line in FIG. 2(B). Namely, practical compensation of fuel amount is performed by adding the fuel amount as illustrated by hatched area in FIG. 2(B). By compensating the fuel amount, air/fuel ratio MR varies as shown by broken line in FIG. 2(C).

Practical process of correction of the fuel injection amount for compensation of wetting fuel amount. In 4-cycle engine, combustion takes place once in every other cycle. Therefore, the fuel injection amount QF injected by each of the fuel injection valves 4*a*, 4*b*, 4*c* and 4*d* and the fuel amount QFC introduced into corresponding combustion chamber can be described by the following equation:

$$\Delta QFC/\Delta QF=\{\alpha-(\alpha-\beta)Z^{-1}\}/\{1-(1-\beta)Z^{-1}\} \quad (1)$$

where $\alpha$ and $\beta$ are constants.

In the alternative, the fuel injection amount QF and the fuel amount QFC can also be described as:

$$\Delta QFC(k)=(1-\beta)\times x(k)+(1-\alpha)\times\Delta QF(k) \quad (2)$$

where k is a timing in the two engine revolution cycles, $Z^{-1}$ is operator representative of lag factor in two engine revolution cycles, ΔQF and ΔQFC are variation from the fuel injection amount QF and the introduced fuel amount QFC at a predetermined reference engine driving condition, x(k) is variation of wetting fuel amount, and $\alpha$ and $\beta$ are constants which are derived according to the characteristics of the engine and can be variable depending upon the engine temperature, an engine speed, intake air flow rate and so forth.

Figure 3:
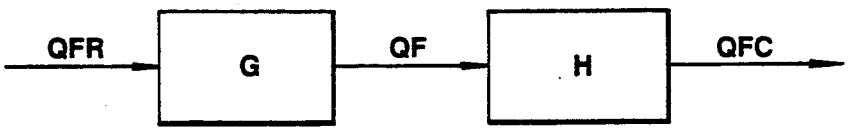
FIG. 3 is a schematic block diagram of a circuit for deriving the fuel amount to be introduced into the combustion chamber.

Correction of the fuel injection amount can be performed by deriving a fuel transfer characteristics H(Z) and deriving a reversal G(Z) of the fuel transferring characteristics, which reversal serves as the wetting fuel compensating correction value. The function may be separated into two stages for deriving the transferring characteristics and the reversal of the transferring characteristics in the circuit illustrated in FIG. 3. The reversal of the transferring characteristics can be derived from the following equation:

$$G(Z)=\{1-(1-\beta)Z^{31\ 1}\}/(\alpha-\beta)Z^{(1)}) \quad (3)$$

From the above, the transfer characteristics W(Z) can be illustrated by the following formula:

$$\begin{aligned} W(Z) &= \Delta QF/\Delta QFR \times \Delta QFC/\Delta QF \\ &= G(Z) \times H(Z) = 1 \end{aligned} \quad (4)$$

The reversal can be derived from the following equations:

$$\Delta QF(k)=(\beta/\alpha^2)\times y(k)+(1/\alpha)\times\Delta QFR(k)$$

$$y(k+1)=(1-\beta/\alpha)\times y(k)+(\alpha-1)\times\Delta QFR(k) \quad (5)$$

where y(k) is internal condition at a timing k.

However, when the aforementioned formula (5) is used for correction of the fuel injection amount, since the value y(k) does not represent the physical value corresponding to the wetting fuel amount x(k), it is not possible to achieve W(Z)=1 in certain engine operating conditions. In order to avoid this drawback, the following equations are better to be used:

$$\Delta QF(k)=(1/\alpha)\times(\Delta QFR(k)-\beta\times y(k))$$

$$v(k+1)=(1-\beta)\times y(k)+(1-\alpha)\times\Delta QF(k) \quad (6)$$

where v(k) represents variation of the wetting fuel amount and thus represents the same physical value to x(k).

By utilizing the aforementioned equation (6), it becomes possible to make correction for the fuel injection amount by determining the constants $\alpha$ and $\beta$ depending upon the engine driving condition by way of table or map look-up.

The fuel injection amount QF(k) and a target fuel amount QFR(k) to be introduced into the combustion chamber can be derived from the following equations:

$$QF(k)=\Delta QF(k)+QF_0$$

$$QFR(k)=\Delta QFR(k)+QFR_0$$

where $QF_0$ and $QFR_0$ are reference values at the reference engine driving condition.

Figure 4:
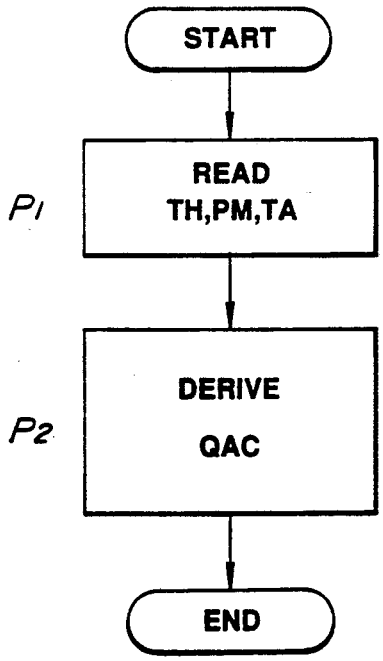
FIG. 4 is a flowchart showing a routine for deriving intake air amount introduced into an engine combustion chamber.

FIG. 4 shows a flowchart showing process of calculating the intake air amount QAC introduced into the engine cylinder. The routine shown is executed as an interrupt routine which is executed at a given interval interrupting a main routine executed as background job and governing various routines.

Immediately after starting execution, the throttle angular position indicative signal TH input through the input port $I_{TH}$, the intake air pressure indicative signal PM input through the input port $I_{PM}$ and intake air temperature indicative signal TA through the input port $I_{TA}$ are read out at a step P1. The throttle angular position indicative signal TH, the intake air pressure indicative signal PM and the intake air temperature indicative signal TA are input in analog form. Therefore, A/D converter 36 converts the input signals to establish digital form throttle angle data, the intake air pressure data and the intake air temperature data. Based on the throttle angle data TH, the intake air pressure data PM and the intake air temperature data TA, the intake air amount QAC to be introduced into the engine cylinder, is arithmetically derived at a step P2.

Process of derivation of the intake air amount QAC to be introduced into the engine cylinder has been disclosed in the Japanese Patent First (unexamined) Publication 62-206241. In the alternative, the technology for arithmetically deriving the intake air amount has been disclosed in the U.S. patent application Ser. No. 195,975, filed on May 19, 1988, now U.S. Pat. No. 4,892,072 issued Jan. 9, 1990, and assigned to the common assignee to the present invention. The disclosures of the above-identified Japanese Patent First Publication and the U.S. patent application will be herein incorporated by reference for the sake of disclosure.

Figure 5:
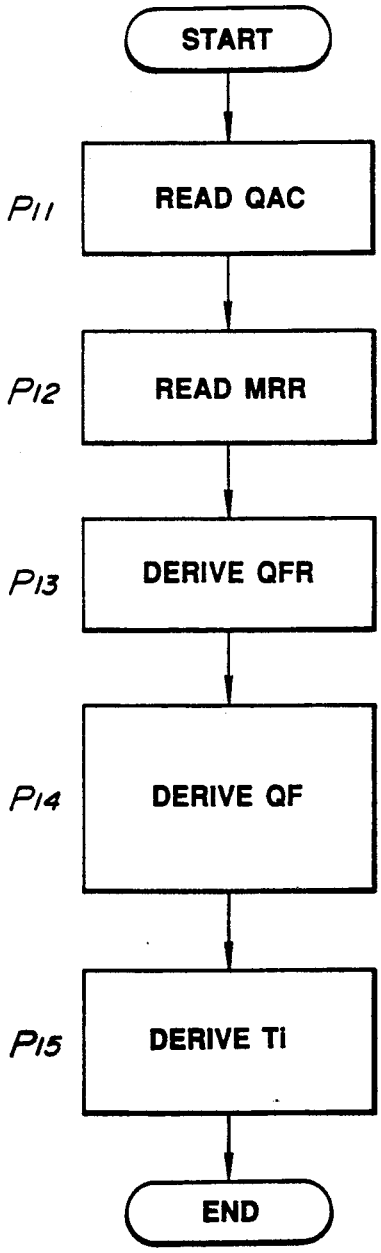
FIG. 5 is a flowchart showing a routine for deriving a fuel injection pulse.

The process illustrated in FIG. 5 is triggered by crank reference signals Ca. Therefore, in the embodiment shown, the process shown is performed every 180° of engine revolution.

Immediately after starting execution, the intake air amount QAC(k) introduced into the combustion chamber derived through the process in FIG. 4, is read out, at a step P11. At a step P12, a target air fuel ratio MRR(k) is derived and read out. As set forth above, the target air/fuel ratio MRR(k) is derived on the basis of the engine speed. The target air/fuel ratio MRR(k) can be variable depending upon the engine driving condition, i.e. steady state and transition state. At a step P13, a target fuel amount QFR is arithmetically derived according to the following equation:

$$QFR=QAC/MRR \quad (9)$$

Then, at a step P14, the target fuel amount QFR is corrected with the reversal G(Z) derived through the process as described by the equation (6). In the process of correction, the reversal G(Z) represents reversed characteristics of transition characteristics of variation of fuel amount QFC to be introduced into the combustion chamber in response to variation of the fuel injection amount. The fuel injection pulse width Ti is then derived at a step P15 so that the fuel injection amount becomes equal to the target fuel amount QFR as modified at the step P14. The fuel injection pulse width Ti is derived in view of the construction of the engine, type and configuration of the fuel injection valves 4a, 4b, 4c and 4d, a fuel pressure applied to the fuel injection valves. In practice, the fuel injection pulse width Ti(k) is derived by the following equations:

$$Ti=TE(k) \quad (3)$$

$$TE(k)=l_1\times QF(k)+l_2$$

$$TS(k)=l_3\times VB+l_4 \quad (4)$$

where $l_1$ to $l_4$ are constant; and

VB is a battery voltage.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

Figure 6:
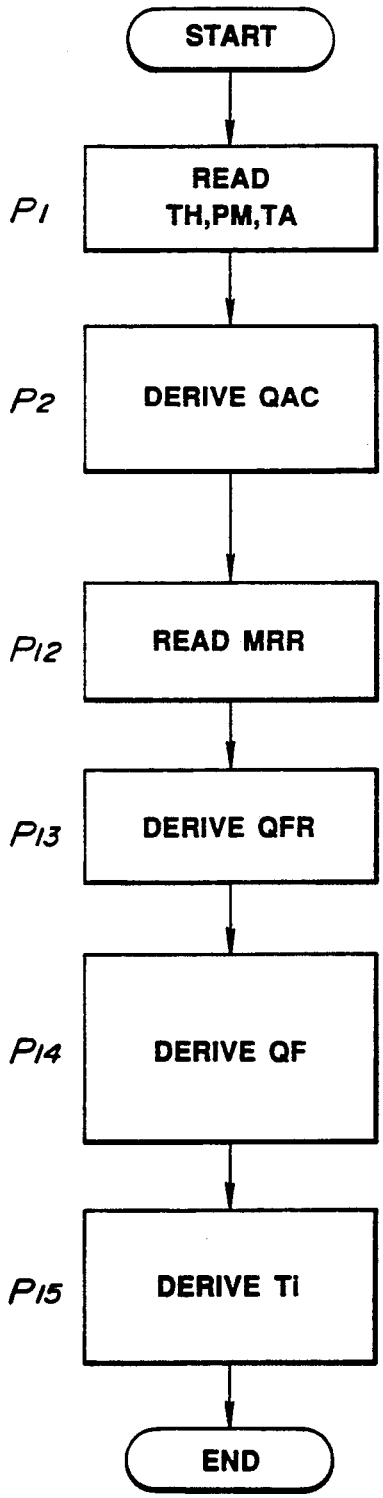
FIG. 6 is a flowchart showing another routine for deriving a fuel injection pulse.

For example, though the preferred embodiment set forth above employs the separate routine for deriving the intake air amount QAC to be introduced into the combustion chamber and the fuel injection pulse width Ti, it is possible to perform the same operation with a single and series routine as shown in FIG. 6.

What is claimed is:

1. A fuel injection quantity control system for an internal combustion engine, comprising:

a sensor means for monitoring an engine driving condition to produce an engine driving condition indicative parameter signal;

first means for deriving a target air/fuel ratio of an air/fuel mixture to be combusted in a combustion chamber of the engine, said first means deriving a target fuel amount to be introduced into said combustion chamber for establishing said target air/fuel ratio;

second means for deriving a lag factor in variation of a fuel amount introduced into said combustion chamber relation to variation of a fuel injection amount including means for deriving a ratio of fuel amount variation of actually introduced fuel versus variation of injected fuel amount and a correction value for correcting said target fuel amount on the basis of said ratio of variation of introduced fuel amount versus variation of injected fuel amount so as to establish and air/fuel mixture at said target air/fuel mixture upon introduction into said combustion chamber, said second means varying said correction value according to correction value variation characteristics which have reversed characteristics to the variation characteristics of the fuel amount to be introduced into said combustion chamber; and third means for deriving a fuel injection control signal based on said target fuel amount for injecting a fuel in an amount corresponding to said target fuel amount.

2. A fuel injection quantity control system as set forth in claim 1, wherein said second means derives said correction value based on known variation characteristics of fuel amount to be introduced into said combustion chamber in relation to stepwise variation of said fuel injection amount.

3. A fuel injection quantity control system for an internal combustion engine, comprising:

a sensor means for monitoring an engine driving condition to produce an engine driving condition indicative parameter signal;

first means for deriving a target air/fuel ratio of an air/fuel mixture to be combusted in a combustion chamber of the engine on the basis of said engine driving condition indicative parameter signal, said first means deriving a target fuel amount to be introduced into said combustion chamber for establishing said target air/fuel ratio on the basis of an intake air amount to be introduced into said combustion chamber;

second means for deriving a wetting fuel dependent lag factor depending upon an amount of fuel left on an inner periphery of an induction system of said engine, in variation of a fuel amount introduced into said combustion chamber in relation to variation of a fuel injection amount including means for deriving a ratio of fuel amount variation of actually introduced fuel versus variation of injected fuel amount and a correction value for correcting said target fuel amount which correction value is variable according to the reverse characteristics of the variation characteristics of the fuel amount to be introduced into said combustion chamber, so as to establish an air/fuel mixture at said target air/fuel mixture upon introduction into said combustion chamber; and third means for deriving a fuel injection control signal based on said target fuel amount for injecting a fuel in an amount corresponding to said target fuel amount.

4. A fuel injection quantity control system as set forth in claim 3, wherein said sensor means monitors a throttle valve angular position, an intake air pressure and an intake air temperature, and said system comprises fourth means for deriving said intake air amount to be introduced into said combustion chamber on the basis of said throttle valve angular position, said intake air pressure and said intake air temperature.

5. A fuel injection quantity control system as set forth in claim 4, wherein said second means derives said correction value based on known variation characteristics of fuel amount to be introduced into said combustion chamber in relation to stepwise variation of said fuel injection amount.

6. A fuel injection quantity control system for an internal combustion engine, comprising:

a) a first sensor for monitoring a throttle valve angular position of an engine throttle valve for producing a throttle angle indicative signal;

b) a second sensor for monitoring a parameter associated with an intake air density for producing an intake air density indicative signal;

c) a third sensor for monitoring intake air pressure for producing an intake air pressure indicative signal;

d) first means for arithmetically deriving a variable of intake air quantity sucked into each combustion chamber on the basis of said throttle angle indicative signal, said intake air density indicative signal and said intake air pressure indicative signal;

e) second means for deriving a target air/fuel ratio of an air/fuel mixture combusted in said combustion chamber of the engine on the basis of said intake air quantity, said first means furthermore deriving a target fuel amount to be introduced into said combustion chamber for establishing said target air/fuel ratio;

f) third means for deriving a lag factor in variation of a fuel amount introduced into said combustion chamber in relation to variation of a fuel injection amount, said third means including means for driving a transfer characteristic of fuel on the basis of fuel amount variation of actually introduced fuel versus variation of injected fuel amount and a correction value for correcting said target fuel amount as a function of a reversal of the transfer characteristic of injected fuel introduced to the combustion chamber so as to establish an air/fuel mixture at said target air fuel mixture upon introduction into said combustion chamber; and g) fourth means for deriving a fuel injection quantity control signal based on said target fuel amount for injecting a fuel in an amount corresponding to said target fuel amount.

7. A fuel injection control quantity system for an internal combustion engine, comprising:

a sensor means for monitoring an engine driving condition to produce an engine driving condition indicative parameter signal;

first means for deriving a target air/fuel ratio of an air fuel mixture to be combusted in a combustion chamber of the engine, said first means deriving a target fuel amount to be introduced into said combustion chamber for establishing said target air/fuel ratio;

second means for deriving a lag factor in variation of fuel amount introduced into said combustion chamber in relation to variation of fuel injection amount including means for deriving a ratio of fuel amount variation of actually introduced fuel versus variation of injected fuel amount and a correction value for correcting said target fuel amount, said second means varying said correction value according to correction value variation characteristics which have reversed characteristics from the variation characteristics of the fuel amount to be introduced into said combustion chamber; and third means for deriving a fuel injection control signal based on said target fuel amount for injecting fuel in an amount corresponding to said target fuel amount.

* * * * *